United States Patent [19]

Hall

[11] 4,285,069

[45] Aug. 25, 1981

[54] GARTER BELT

[76] Inventor: Gwendolyn L. Hall, 60 Redcar Ave., Islington, Ontario, Canada, M9B 1K1

[21] Appl. No.: 46,035

[22] Filed: Jun. 6, 1979

[51] Int. Cl.[3] ..... A41F 9/00

[52] U.S. Cl. ..... 2/314

[58] Field of Search ..... 128/158, 159, 165, 535; 2/314, 313, 302, 304

[56] References Cited

U.S. PATENT DOCUMENTS

| | | | |
|---|---|---|---|
| 1,359,672 | 11/1920 | Cavalier | 2/313 |
| 1,815,456 | 7/1931 | Abraham | 2/314 |
| 3,880,160 | 4/1975 | Hall | 128/158 |
| 3,880,161 | 4/1975 | Fossel | 128/165 |

*Primary Examiner*—Doris L. Troutman

[57] ABSTRACT

A garter belt for athletes has a stretchable band extending about the body with its free ends meeting at the front in a shallow upward V. Four straps depend from the forward portion of the band located in pairs on opposite sides of the free end junction. The four straps are each adjustable as to length and there is a fastener on each strap.

6 Claims, 3 Drawing Figures

GARTER BELT

Figure 1:
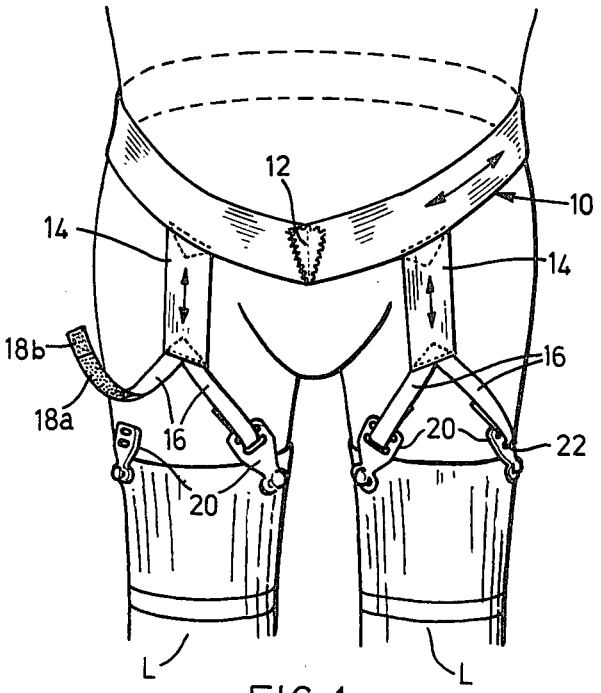

This invention relates to a garter belt for athletes, (male or female) to suspend stockings or socks while playing hockey, or other sports.

The garter belt in accord with the invention includes a band made of material, resiliently stretchable in a direction about the body. The band is designed to ride on the body above the hips but to slope downwardly, to a shallow upwardly directed V at the front of the body. The stockings or socks are supported by straps attached to the band at the front of the body. The forward portion of the band, sloping upwardly and outwardly from the V, effectively transfers the tension applied by the socks or stockings or by shin pads contained therein to the portion of the band extending above the hips and around the back of the waist. The result is that the band exerts no pressure or tension on the front of the body. The shaping of the band is achieved by sewing the ends of the bands in overlapping relationship at the front of the body so that at the sewn portion the shallow upwardly directed V is formed.

The band is preferably formed of a single piece of material stretchable in the direction about the body. The material is preferably one-way stretch material.

On each side of the front portion of the band a pair of straps depend. These have fasteners for the socks or stockings and are preferably of adjustable length. The arrangement is such that a strap of such a pair may be attached to each side of each stocking or sock rather than attached at the front or back thereof. The upward 'pull' of the straps on the sock is thus slightly forward but does not apply any appreciable twist or torque thereto, since any torque applied by one strap of the pair tends to be cancelled by the other. This is of considerable importance to the comfort of the wearer and the appearance of the sock. It will also be noted that the upward pull of the straps at each side of the sock, tends to provide strain lines in the sock, on each side of the shin guard tending to hold it in position at the front of the sock or stocking.

Preferably the band, on either side of its forward portion, is provided with an upper strap joining the band to a pair of fastener-bearing strap with fasteners thereon. The upper strap is preferably vertically stretchable but preferably not otherwise adjustable in length. The pair of straps with fasteners are preferably adjustable in length but not stretchable. This provides a convenient and effective combination of a stretchable and adjustable length connection between the socks and the band and contributes to the comfort of the wearer. The upper straps are preferably of one way stretch material. The four adjustable, fastener-bearing straps are preferably of the hook-pile fastener type (exemplified by the product sold under the trade mark "Velcro") backed with strips of hook and pile which allows these straps to be made of adjustable length. A loop may be formed at variable lengths from the upper attachment of the strap by adjustment of the hook-pile connection.

The closest prior art known to applicant is contained in U.S. Pat. No. 3,880,160 which issued on Apr. 29, 1975 to applicant, and the patents cited thereagainst; and in copending U.S. Application, Ser. No. 826,149 filed Aug. 19, 1977 by the applicant and another, and the patents cited by the Examiner against such application.

Figure 3:
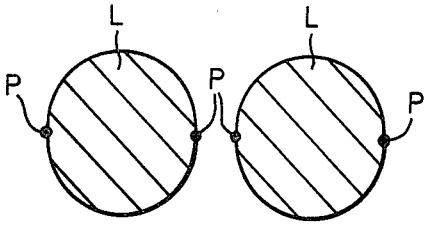
Figure 2:
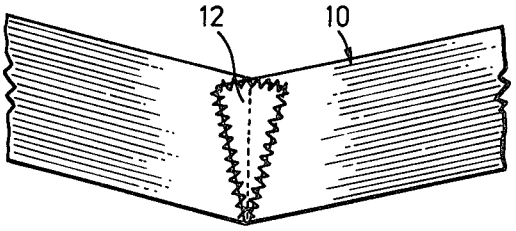

In drawings which illustrate a preferred embodiment of the invention:

FIG. 1 is a view showing the band worn on the body and supporting hockey socks, FIG. 2 is an enlarged view showing the shallow V sewn portion at the front of the band, FIG. 3 is a schematic view indicating the points of attachment of the fastener straps to the socks relative to the leg.

In the drawings, is shown a band 10 made of one piece of material stretchable over the hips and about the back of the waist. The band ends are sewn in overlapping relationship at 12 in a shallow upwardly directed V as best shown in FIG. 2. As best shown in FIG. 1, this overlap in a shallow V, provides a band which is high at the back and low at the front and rides above the hips around the back of the waist. The shallow V form transfers the downward pull of the socks into a sloping pull along the band 10 to the back of the band where it may be comfortably borne by the body.

Midway between the front, central sewn portion 12 of the band and the sides are sewn the upper ends of vertically dependent upper straps 14 of one way stretch material stretchable in a vertical direction.

At the lower ends of each of the upper straps 14 is sewn the upper ends of a pair of preferably non-extensible fastener bearing straps 16. These are preferably sewn to diverge downwardly at right angles to each other when viewed from the front of the upper straps 14.

The fastener straps 16 are hook-pile type as best shown in FIG. 1 with a strip of pile material 18A following a strip of hook material 18B, or vice versa. As will be obvious, such arrangement and the natural action of the hook-pile material allows the formation of loops in the straps at selectable length from the upper ends of the strap.

The fastener straps 16 carry thereon fasteners 20 for attachment to the socks. The fastener straps 16 are preferably not stretchable but due to quality of the velcro may define lower loops 22 for the fasteners 20 at a range of lengths from the upper straps 14. The fastener 20 may be of any type which will attach to the sock and mounted the fastener strap. I prefer to use the fastener shown in copending application No. 829,149 referred to earlier but this may be considered as a matter of choice.

The provision of four straps 16 suspended in pairs on opposite sides of the front of the band allows attachment of the pairs of straps, to the inside and outside points P of the leg L as shown schematically in FIG. 3. It will be seen by reference also to FIG. 1 that the result is a slight forward pull that transfers the tension on the band locations on the body over the hips and across the back of the waist. However, the torque on each sock is small and equal in both directions about each leg. This is important for the appearance of the sock and the comfort of the wearer as this transfer of tension eliminates all strain and pressure on the front of the body. Thus the band does not support the body but merely the socks or stockings usually having shin-guards located therein.

Although the form of the invention described above is very much preferred to alternatives within its scope, the following alternatives are noted.

The fabric of the band may be of two way stretch material. The band could be of two or more pieces. These alternatives would appear to me to add to the expense without adding to the comfort of the device.

The four fastener straps may be attached to the band directly without use of the upper strap and may be made both stretchable and or length adjustable. However this is believed considerably inferior to the arrangement shown.

A length adjustment may be provided in any form well known to those skilled in the art, as a alternative to the use of hook-pile material.

So far as alternatives generally, to the specific construction shown, I do not consider my invention limited by the comments above but only by the scope of the appended claims.

I claim:

1. Garter belt for athletes, comprising:

a band of material designed to extend about the body of the wearer, above the hips and around the back of the waist and comprising a forward portion and a rearward portion, to be worn, respectively, at the front and rear of the body;

said band having free ends sewn together in overlapping relationship substantially at the centre of the forward portion, said ends, in said overlapping relationship being sewn so that they define for the band, at such overlap, a shallow upwardly directed V, whereby the forward portion of the band rides lower on the body than the rearward portion, the material of said band being stretchable in at least the direction extending about the body, an upper strap attached at its upper end to the forward portion of each band on each side of and spaced from said V, each said upper strap being also spaced from the adjacent rearward portion, said upper strap being so attached at its upper end to depend downwardly from said band, two lower straps attached to and depending from the lower end of each upper strap, means for adjusting the length of each of said lower straps, a fastener designed to be located at the lower end of the adjusted length of each of said lower straps.

2. Garter belt as claimed in claim 1 wherein said band is a single piece of material.

3. Garter belt as claimed in claim 2 wherein said band is of one way stretch material.

4. Garter belt as claimed in claim 1 wherein said upper straps are of one way stretch material, said one way being in the direction between said band and the lower straps.

5. Garter belt as claimed in claim 1 wherein said lower straps are each of the hook-pile fastener type for forming a loop of adjustable length from said upper strap and wherein a fastener is slidable on each of said lower straps.

6. Garter belt as claimed in claim 4 wherein said lower straps are each of the hook-pile fastener type for forming a loop of adjustable length from said upper strap and wherein a fastener is slidable on each of said lower straps.

* * * * *